United States Patent [19]

Sprenger

[11] Patent Number: 4,707,591

[45] Date of Patent: Nov. 17, 1987

[54] ELECTRICALLY HEATABLE AUTOMOBILE WINDOW POWER-SUPPLY CONNECTOR ASSEMBLY

[75] Inventor: Willi Sprenger, Wallrabenstein, Fed. Rep. of Germany

[73] Assignee: General Motors Corporation, Detroit, Mich.

[21] Appl. No.: 877,810

[22] Filed: Jun. 24, 1986

[30] Foreign Application Priority Data

Jun. 28, 1985 [DE] Fed. Rep. of Germany ..... 3523228

[51] Int. Cl.[4] ..... H05B 3/08; H01R 11/22; H01H 3/62

[52] U.S. Cl. ..... 219/541; 219/203; 219/522; 219/543; 219/547; 338/308; 338/309; 200/61.78; 200/61.81; 439/34; 439/824

[58] Field of Search ..... 219/203, 522, 541, 543, 219/547; 338/308, 309; 339/255 R; 200/61.78, 61.81

[56] References Cited

U.S. PATENT DOCUMENTS 4,029,375 6/1977 Gabrelian ..... 339/17 M
4,181,833 1/1980 Cumming et al. ..... 200/61.62
4,542,282 9/1985 Brasky ..... 219/345

FOREIGN PATENT DOCUMENTS 6944638 2/1970 Fed. Rep. of Germany .
7720017 11/1977 Fed. Rep. of Germany .

*Primary Examiner*—Clifford C. Shaw
*Assistant Examiner*—Gerald E. Preston
*Attorney, Agent, or Firm*—F. J. Fodale

[57] ABSTRACT

An electrically heatable fixed rear window of a motor vehicle has resistance heating strips extending over part of the window area and a bus bar which electrically connects the resistance heating strips to each other and provides a contact on the window which cooperates with, and a counter-contact on the motor vehicle body which is connected to an electrical power source such as the motor vehicle battery.

The counter-contact on the motor vehicle body comprises a compression spring-loaded pin which moves in the direction perpendicularly of the window surface, which is connected at its rear end to a power cable connected to the electrical power source and which is operatively connected to the bus bar at its front end surface.

9 Claims, 6 Drawing Figures

ELECTRICALLY HEATABLE AUTOMOBILE WINDOW POWER-SUPPLY CONNECTOR ASSEMBLY

This invention relates generally to an electrically heatable window, and more particularly to an electrically heatable rear window of the fixed, non-openable type for a motor vehicle.

Electrically heatable windows of the above noted type include resistance heating strips which extend over at least a portion of the the window surface area and which are electrically interconnected by a bus bar, terminal means which are disposed on the window and connected with the heating strips, and counter-terminal means which are disposed on the vehicle body and connected to a current source such as the vehicle battery. The terminal and counter-terminal means are usually of the pressure contact type and, the arrangement is usually such tht when the window pane is in the installed, i.e., in the closed position, the terminal and counter terminal means are in electrical contact with each other so that the circuit between the current source and the resistance heating elements is closed. The establishment of this electrical contact is normally assisted by the bias of a spring.

In accordance with state-of-the art technology, the procedures for providing the electrical current supply to the resistance elements in the rear windows of motor vehicles is as follows. The terminals, which are originally flat, are soldered to the resistance elements by the manufacturer of the heatable window. The reason that the terminals are flat originally is to facilitate shipping of the windows.

Prior to the installaion of the window, the terminals are bent upwardly by the vehicle manufacturer, so that at least one tang of the terminals is in a generally upright position. However, this bending procedure may cause the terminal to be severed at the soldering connection from the resistance elements or the window, which may result in increased costs and production delays. If the terminal strips, after having been bent upwardly, remain in position, the window can be installed into the vehicle, and the cable connected with the battery can now be plugged into the terminal elements on the plus and minus side.

The provision of special terminal elements on an electrically heatable window is associated with various types of problems. Such special terminal elements not only require the application of special manufacturing procedures and therefore increase manufacturing costs, they also break off easily and usually cannot be repaired thereafter. Furthermore, they interfere with the cleaning of the window and may even cause injuries.

Another electrically heatable window of the type described in the foregoing is disclosed in DE-GM 77 20 017. However, the window disclosed in this German utility patent is of the type that can be opened, whereas the present invention is primarily directed to windows of the fixed, i.e., non-openable type, especially rear windows for motor vehicles.

The prior art window according to DE-GM 77 20 017 is intended for installation into a fixed frame, i.e., a frame which is part of a motor vehicle body, and the vehicle window as well as the body-mounted frame or the vehicle body are provided with electrical contact elements which, at least when the window is closed, are adapted to close an electrical circuit. This German utility patent also proposes the contact elements of the motor vehicle window and those of the vehicle body be of the pressure contact type and that they be retained in engagement with each other through the additional force exerted by a compression-type spring.

Because the heatable window according to DE-GM 77 20 017 is of the slideable type, the counter contact provided on the vehicle body is arranged parallel to the window surface area. The disadvantage of this arrangement is that the electrical contact between the window and the vehicle body is not always reliable.

It is the object of the present invention to provide a simplified arrangement for establishing the electrical connection between the resistance heating strips and the current supply cable, to eliminate potential causes of contact failure and to provide an arrangement that is less costly than prior-art arrangements. In accordance with the invention, this object is achieved in an electrically heatable window of the type described in the foregoing in that the bus bar serves, as is usual, as the electrical contact means for the window, and in that the counter contact provided on the vehicle body is in the form of a spring-biased pin which is oriented substantially perpendicularly to the window surface and which is adapted for displacement in the direction of the window. The aforementiond pin has its rearwardly disposed end connected with the cable supplying the current from the current source, and the forwardly disposed end face of the pin is adapted for engagement with the bus bar.

The invention enables economical manufacturing and facilitates shipping and installation of the window, thus obviating the need for additional connecting elements for the current supply cable. Upon installation, the window establishes electrical contact via the bus bar with the pin which serves as a counter contact means, so that there is no need for additional operations or parts.

While the German utility patent DE-GM 69 44 638 also discloses an arrangement wherein the bus bar of a heatable window is used as a contact element for the window, the electrical connection between the bus bar and the current supply cable in this prior art disclosure is established by a rubber suction cup which is provided on its inside with a counter contact. The counter contact is urged by the rubber suction cup against a transversely extending conductor elements, e.g., the bus bar window, and is thereby put into electrical contact with the same. It is generally known that these suction cups separate and dislodge from the window after a period of time, and it is for this reason alone that this prior-art solution lacks in durability and reliability. What is more, these suction-type connections are relatively expensive and requires more manual operating steps than the arrangement proposed by the present invention. In accordance with the present invention, the electrical connection is already being established at the time the window is inserted into the vehicle body, whereas in the arrangement according to DE-GM 69 44 638, a separate operation is required for applying the suction member onto the window, and one prerequisite is that the engagement surface on the window and the suction cup are absolutely clean. The latter requirement is necessary to ensure that the connection between the suction element and the window is air-tight.

Based on the considerations enumerated in the foregoing, the arrangement proposed in the German utility patent DE-GM 69 44 638 is only suitable for custom or after-installation work, but not in situations that require the application of mass-production techniques.

Other features that may be incorporated in the embodiments are identified in the claims. Additional advantages and details will become apparent from a review of the attached drawings and the following description of several representative embodiments in which:

Figure 1:
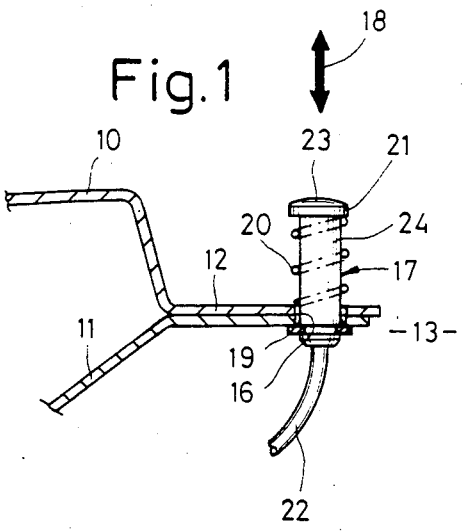
FIG. 1 is a portion of a vehicle body in the region of the opening provided for the rear window.
Figure 2:
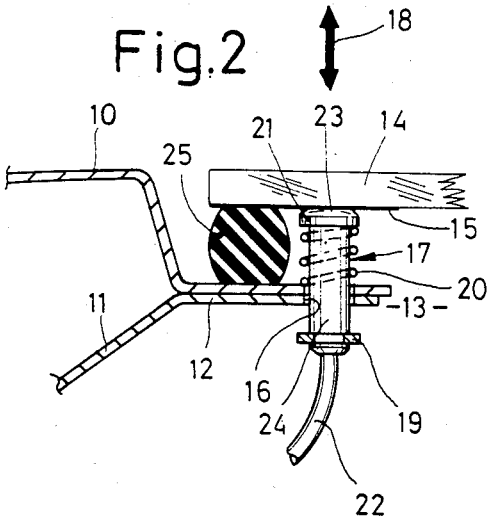
FIG. 2 is an arrangement according to the invention illustrating, in part, a heatable rear window in the installed position.

Referring now to the drawing, the numerals 10 and 11 in FIG. 1 denote two sheet metal members of a vehicle body which are arranged so as to form a flange 12. Flange 12 defines the opening for a heatable window 14 which is partially illustrated in FIG. 2. The window 14 is provided with a plurality of electrical resistance heating strips which are generally known in the art and therefore not illustrated in the drawing. The electrical resistance heating strips are connected, as is usual, to a bus bar. The bus bar, which is illustrated in FIG. 2 and denoted by the numeral 15, is arranged on the edge of the window 14 and on that side of the window surface which is confronting the flange 12. The bus bar 15 may extend inwardly of the window 14 to establish contact with the resistance heating strips if the strips, as is common with laminated window panes, are embedded in the window.

The flange 12 has a bore 16 through which a pin 17 extends. The pin 17 is inserted in the bore for axial displacement therein and, as apparent from FIG. 2, the pin 17 extends perpendicularly to the window 14. Furthermore, the pin 17 has attached to its rearward end a collar 19 which serves as a stop means to retain the pin 17 in its extended position, as shown in FIG. 1, prior to installation of the window 14 into the vehicle body. The pin 17 is urged in this extended position, which is illustrated in FIG. 1, by the bias of a coil-type compression spring 20 which bears against the flange 12 of the sheet metal and the metallic head 21 of the pin 17. When the window 14 is installed into the vehicle body, the pin 17, as apparent from FIG. 2, is depressed (i.e., displaced rearwardly), which requires that the force of the compression spring 20 is overcome. However, the coil-type compression spring 20 is designed so that its resistance can be overcome simply by the installation weight of the window 14.

As is also apparent from FIGS. 1 and 2, the contact pin 17 has its rearwardly facing end connected to a current supply cable 22 which is electrically communicated, in a manner not illustrated in the drawings, to a suitable current source, such as the vehicle battery. Preferably, the contact pin 17 is contained in a plastic sleeve 24 which extends from the metallic head 21 to the collar 19. The plastic sleeve 24 serves as an insulating means between the cable 22 and the vehicle body and enables the current to be forwarded from said cable 22 to the metallic head 21. As illustrated in FIG. 2, the metallic head 21, which has its concave contact surface 23 in engagement with thee bus bar 15, serves as the counter contact on the body side so as to interact with the contact on the window side, which is in the form of a bus bar 15. To provide optimum conductivity between the two contacts 21 and 15, it is proposed that the counter contact 21 be of the same material as the resistance heating strips and/or the bus bar 15, for example, a suitable copper alloy.

The point of contact between the bus bar and counter contact formed by the contact pin 17 or head 21 is located, preferably, on a level that is midway of the window 14.

FIG. 2 illustrates the window 14 in the installed position in which the electrical connection to the current source such as the vehicle battery, is established. The spacing of the window 14 and the contact pin 17 is determined by the thickness of the adhesive bead 25 which serves as a means to fix the window 14 on the flange-like edge 12 into its final installed position. Preferably, the adhesive bead 25 is spaced in close proximity of the contact pin 17, so that relative movement between the window 14 and the contact pin 17 is prevented.

Figure 3:
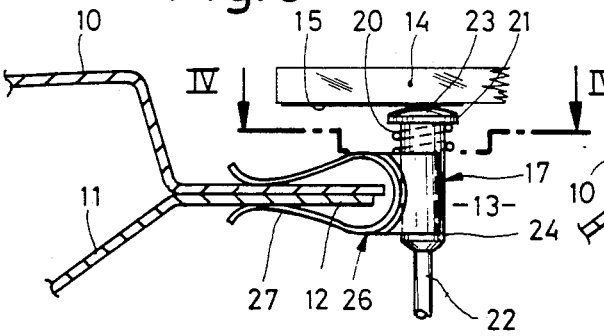
FIG. 3 is another embodiment of the invention, the view of this arrangement corresponding to that of FIG. 2.
Figure 4:
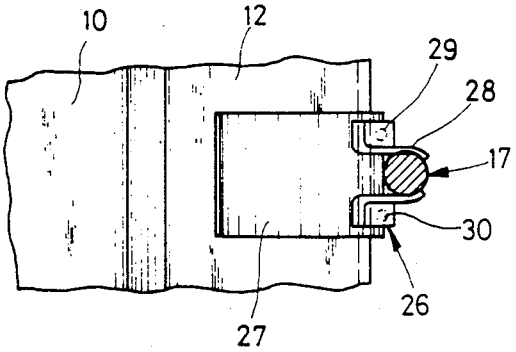
FIG. 4 is a section taken substantially along line IV—IV of FIG. 3 looking in the direction of the arrows.

The embodiment according to FIGS. 3 and 4 differs from the one in FIGS. 1 and 2 only in that the contact pin 17, rather than being arranged in a bore of the flange 12, is mounted in a bracket 26 which, in turn, is detachably clamped to the flange 12. In order to effect this clamping function, the bracket 26 comprises a clamp 27 cooperating with the flange 12 which is made, preferably, of spring steel and a sleeve 28 which is spot-welded at 29, 30 to the clamp 27. The contact pin 17 is retained and guided for axial displacement in the sleeve 28.

Figure 5:
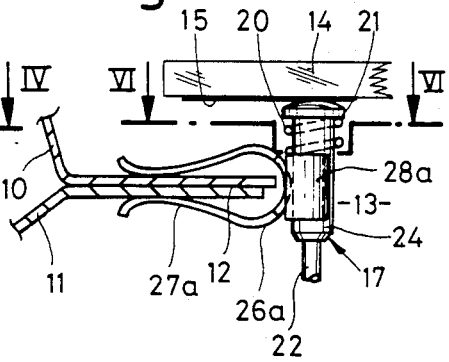
FIG. 5 is a modification of the embodiment according to FIGS. 3 and 4, the view in this figure corresponding to that of FIG. 3.
Figure 6:
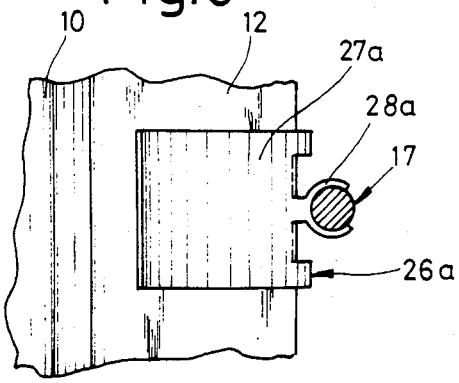
FIG. 6 is a section taken substantially along line VI—VI of FIG. 5 looking in the direction of the arrows.

In the embodiment illustrated in FIGS. 5 and 6, the guide member **28*a* for accommodating the pin 17 is integrally formed on the clamp 27*a* of the bracket 26*a*** so that the operation of spot welding the guide member onto the clamp is not necessary.

In the embodiments according to FIGS. 3 to 6, the elements corresponding to those of FIGS. 1 and 2 have been assigned like reference numerals.

I claim:

1. An electrically heatable window of a motor vehicle having resistance heating strips extending over at least part of the window area, a bus bar electrically connecting the resistance heating strips to each other, a contact on the window associated with the resistance heating strips, and a counter-contact on the motor vehicle body which is connected to an electrical power source such as the motor vehicle battery, contact and counter-contact being constructed as push contacts such that in the assembled or closed position of the window, the contact and counter-contact engage each other with additional spring pressure, closing the electrical circuit between the resistance heating strips and the power source characterized in that, the contact on the window consists of the bus bar itself and the counter-contact on the motor vehicle body is disposed on a flange like edge which serves as a support surface for the window in the assembled or closed position and comprises a compression spring-loaded pin which extends perpendicularly or essentially perpendicularly to the window surface and which is movable in the direction perpendicularly or essentially perpendicularly of the window surface, said spring loaded pin being connected at its rear end to a power cable connected to an electrical power source and operatively connected to the bus bar at its front end surface.

2. An electrically heatable window according to claim 1, characterized in that the window is fixed to the flange-like edge by an adhesive bead which is spaced in close proximity of the compression spring-loaded contact pin serving as the counter-contact so that relative movement between the window and the contact pin is prevented when the window is in the assembled position.

3. An electrically heatable window according to claim 2, characterized in that the compression spring-loaded contact pin serving as the counter-contact is disposed axially movably in a hole in the flange-like edge of the body panels.

4. An electrically heatable window according to claim 2, characterized in that the compression spring-loaded contact pin serving as the counter-contact is disposed movably in a bracket which is connected in releasable clamping relationship to the flange-like edge of the body panels.

5. An electrically heatable window according to claim 4, characterized in fact that the bracket comprises a clamp for cooperating with the flange-like edge which is made of spring steel.

6. An electrically heatable window according to claim 5, characterized in that the bracket comprises a sleeve for retaining and guiding the movable contact pin which is spot welded to the clamp.

7. An electrically heatable window according to claim 5, characterized in that the bracket comprises a sleeve for retaining and guiding the movable contact pin which is formed integrally on the clamp.

8. An electrically heatable window according to claims 1, 2, 3, 4 or 5 characterized in that the contact pin has a head, the front end surface of the contact pin which is operatively connected to the bus bar is a convexly curved surface of the head, and the contact pin is surrounded by a plastic sleeve which serves to insulate supply of power to the convexly curved surface.

9. An electrically heatable window according to claim 1, 2, 3, 4 or 5 characterized in that the compression spring acting on the contact pin in the direction perpendicularly or essentially perpendicularly of the window is constructed as a coil spring and is designed in such a way that its spring resistance can be overcome simply by the installation weight of the window.

* * * * *